US006210268B1

(12) United States Patent
Fleissner

(10) Patent No.: US 6,210,268 B1
(45) Date of Patent: Apr. 3, 2001

(54) AIR MIXER FOR STATIC MIXING OF TWO AIR STREAMS

(75) Inventor: Gerold Fleissner, Zug (CH)

(73) Assignee: Fleissner GmbH & Co., Maschinenfabrik, Egelbach (DE)

( * ) Notice: Subject to any disclaimer, the term of this patent is extended or adjusted under 35 U.S.C. 154(b) by 0 days.

(21) Appl. No.: 09/251,421

(22) Filed: Feb. 17, 1999

(30) Foreign Application Priority Data

Feb. 17, 1998 (DE) ..... 198 06 427

(51) Int. Cl.[7] ..... F26B 11/02

(52) U.S. Cl. ..... 454/262; 454/263; 454/269; 34/122

(58) Field of Search ..... 454/261, 262, 454/263, 269; 34/122, 119, 115

(56) References Cited

U.S. PATENT DOCUMENTS 1,395,938 * 11/1921 Barducci .
2,131,725 * 10/1938 Chester ..... 454/269
3,911,804 * 10/1975 Tao ..... 454/261
4,657,178 * 4/1987 Meckler .
4,793,247 * 12/1988 Verweij ..... 366/338
4,858,519 * 8/1989 Meckler ..... 454/263
5,413,530 * 5/1995 Montaz .
5,463,967 * 11/1995 Gielow et al. ..... 110/104 R
5,779,361 * 7/1998 Sugira ..... 366/340
5,881,756 * 3/1999 Abbasi et al. ..... 137/9

* cited by examiner

*Primary Examiner*—Pamela Wilson
(74) *Attorney, Agent, or Firm*—Antonelli, Terry, Stout & Kraus, LLP

(57) ABSTRACT

The air mixer defined herein serves for static mixing of a heated air stream in a flow channel of a circulated air stream upstream of a heat treatment chamber for drying textile goods or tissue webs for example. For this purpose the air mixer is provided with air mixing parts that consist of hollow bodies arranged in the flow cross section of the first air stream with spaces between them, said bodies being provided to receive and conduct the second air stream with inlet openings and outlet nozzles located endwise on one side.

9 Claims, 1 Drawing Sheet

AIR MIXER FOR STATIC MIXING OF TWO AIR STREAMS

BACKGROUND OF THE INVENTION

The invention relates to an air mixer, located in the flow direction of a heated air stream for example in a flow channel upstream of a heat treatment chamber, for example for drying textile goods or tissue webs, and provided for the static mixing of two air streams of different temperature or quality flowing into one another, for which purpose the air mixer is provided with air mixing parts. Such previously known mixing parts are generally only deflectors that deflect the second air stream.

A dynamic air mixer is know for example from U.S. Pat. No. 4,495,858. In that patent, a fan is provided in a tube that is open to the exterior or to which in any case air is supplied from outside, by which fan a second air stream accelerated by the fan is introduced into the first air stream. The housing of the fan in the flow channel of the first air stream and also the mounts of the fan impede the flow of the first air stream and a low-loss mixing of the two air streams is not possible. For this reason, an additional fan is provided as well.

SUMMARY OF THE INVENTION

The goal of the invention is to permit two airflows to be fed into one another without additional expenditure of energy in such fashion that they automatically mix uniformly on contact.

Taking its departure from the device of the species recited at the outset, to achieve this stated goal, the invention provides that a hollow body is provided in the flow cross section of the first air stream to receive and guide the second air flow. A plurality of hollow bodies is distributed uniformly over the cross section of the flow channel of the first air stream so that simply because of this fact alone a distributed air supply of the second air stream into the cross section of the first air stream takes place. If, in another embodiment of the air mixer, the hollow body narrows toward its outlet end internally and possibly also externally to form a nozzle-shaped air outlet area, the second air stream flows into the first air stream at a higher speed because of this narrowing of the cross section alone, producing vortices that result in the desired mixing.

One special advantage of the device according to the invention is the extremely short mixing paths that result in only a small pressure loss. As a result of the radiating effect of the nozzle at the outlet from the hollow body, the pressure of the gas flowing through is even partially recovered. Advantageously, therefore, the air streams to be mixed have different pressure drops. This is the case for example in the mixing of a gas subject to a vacuum, for example after the air has been drawn out of a screen drum dryer and an added hot gas from another energy source, whose flow has a higher density, higher temperature, and possibly also a higher pressure.

Advantageously, therefore, flowrate differences between the two air streams are advantageous. These air streams can be further influenced without supplying energy, with the second air stream flowing at a higher pressure into the hollow bodies. This can easily be accomplished or intensified by including a diffuser, directly in front of the hollow body for example. As a result, the flowrate of the second air stream is reduced upstream from the hollow body but the hydraulic pressure is increased, so that when the air flows out of the nozzle the desired higher air flow is obtained. This can even be so high that the fan located downstream is driven.

BRIEF DESCRIPTION OF THE DRAWINGS

Several advanced details are also provided on the air mixer. A device of the type according to the invention is shown as an example in the drawing.

DETAILED DESCRIPTION OF THE PREFERRED EMBODIMENTS

Figure 2:
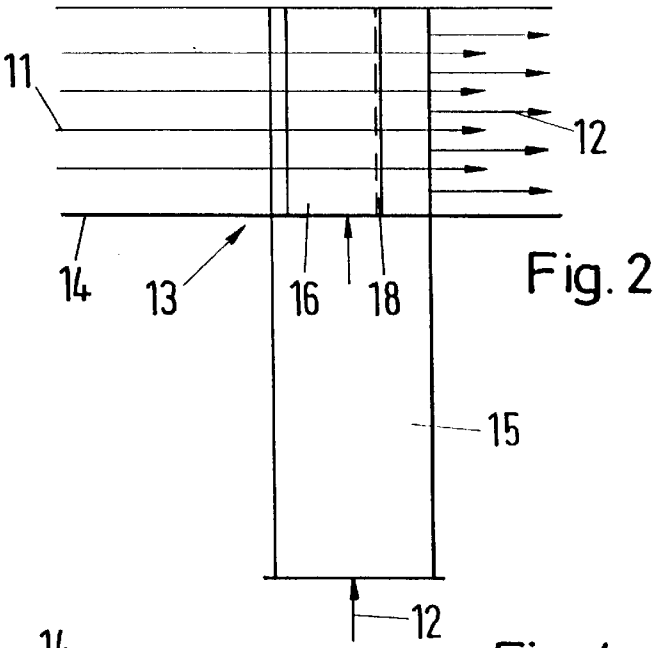
FIG. 2 shows a section perpendicular to the one in FIG. 4 with one of the hollow bodies in an end view.

A screen drum dryer consists of the rotatably mounted screen drum 1, which has the web of goods to be dried wrapped around its exterior. In the area that is not covered by the goods, the screen drum is covered on the inside by an interior covering 3 against air leakage. On the outside, screen drum 1 is surrounded by the air supply housing 4 in the drying area, to which housing the heated drying air 5 is supplied through a pipe 6. The air enriched with moisture from goods 2 is drawn by fan 8 out of the interior of screen drum 1 and recycled to air supply housing 4 heated in a circuit. Previously, a portion 9 of the moist drying air is drawn off through a channel and this part is returned along with dry ambient air from tube 10 to the first air stream 11. Regulation is accomplished by exhaust air flaps, not shown.

The cooled and dry first air stream is heated again in the flow path upstream of fan 8. For this purpose, in the embodiment a hot second air stream 12 is used that possible flows as exhaust air from another energy assembly, not shown, with increased pressure and speed to a mixer 13. The two air streams therefore encounter one another at right angles but this can also take place at any desired angle.

Figure 4:
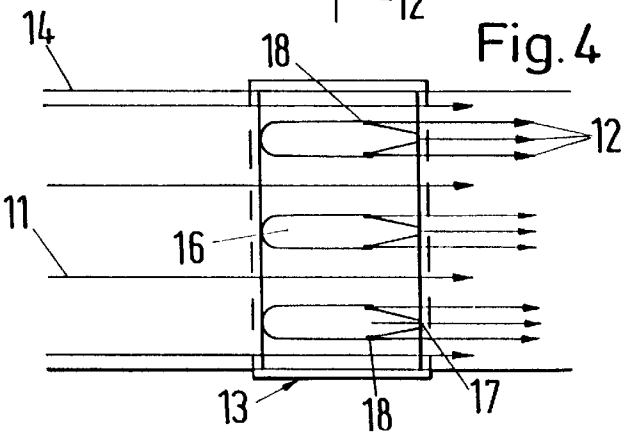
FIG. 4 is a section through the tube of the first air stream in the vicinity of the static air mixer along line IV—IV according to FIG. 3 with the supply nozzles of the second air stream, likewise in cross section.
Figure 1:
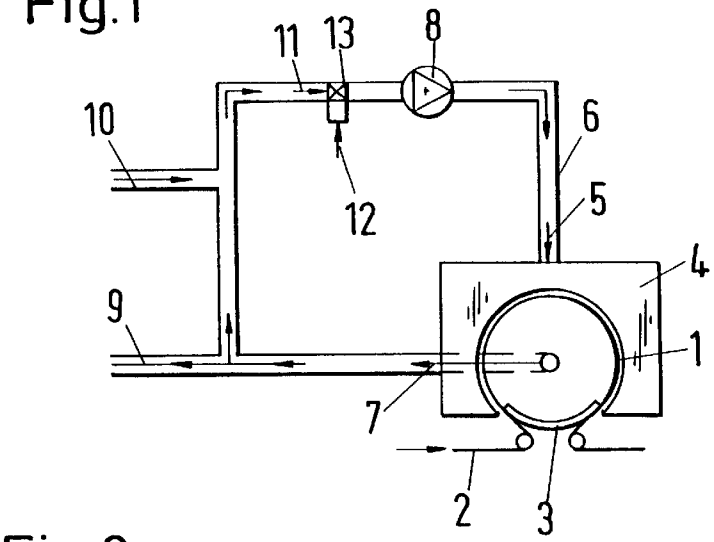
FIG. 1 shows a screen drum dryer in cross section in a schematic representation and on a reduced scale, whose drum interior is subjected to a vacuum with a piping system for renewed acceleration and heating of the circulated air.
Figure 3:
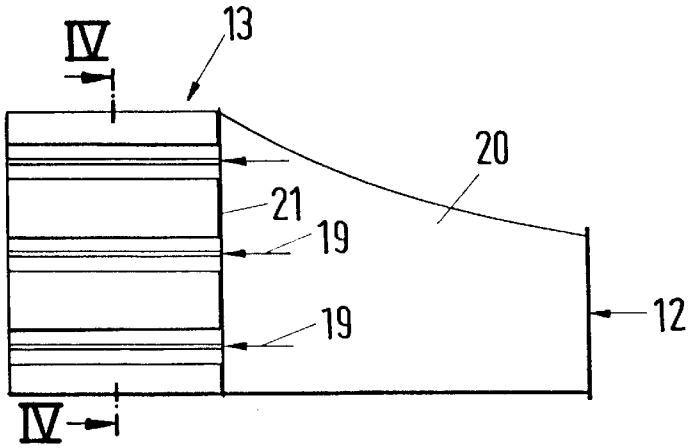
FIG. 3 is a section through the tube of the second air stream in the vicinity of the air mixer with the nozzles as seen from below.

Air mixer 13 is shown in FIGS. 2–4 in individual cross sections. This is a static air mixer, in other words an air mixer in which the mixing of the two air streams is intended to take place as completely as possible due to its intrinsic flow energy. For this purpose, the first flow channel 14 is provided through which the first air stream 11 flows. This air stream is subject to a vacuum because it is drawn in by fan 8. The second hot air stream 12 is drawn in at higher speed through flow channel 15 and strikes the first air stream 11 in the air mixer 13.

For deliberate mixing of the two air streams, hollow bodies 16 open endwise according to FIGS. 3 and 4 with a space between them are located in the air mixer in the direction of the incoming second air stream 12 so that the first air stream 11 can flow between hollow bodies 16. Hollow bodies 16 are made round facing the flow direction of the first air stream 11 so that the air can flow without losses around hollow bodies 16. At the opposite end, the elongate hollow bodies 16 have air outlet nozzles. These air outlet nozzles consist of a main nozzle 17 located centrally in each case, said nozzle being made slit-shaped at the end of the hollow body 16 that narrows to form a nozzle. Two side nozzles 18 are provided on each hollow body 16, said side nozzles being formed where the conical narrowing of nozzle 17 begins and are open at that point.

As stated above, hollow bodies 16 are made open endwise in the direction of the incoming second air stream 12. The remaining area of channel 15 is closed over its cross section by walls 21 so that the hot air can flow in only in the direction of arrows 19 into the vicinity of air mixer 13. The escape of the hot air is permitted only through nozzle openings 17 and 18. Because of this fact, intensive mixing of the two air streams is ensured without additional dynamic vorticization assembly.

An increase in this effect is produced by the diffuser 20 as well which is provided immediately upstream from air mixer 13 in flow channel 15 of second air stream 12. The higher speed of the second air stream is converted by this diffuser into a higher pressure, so that the hot air emerges at even higher speed from the nozzles into the first air stream 11 that is flowing with a vacuum. The resultant vortices produce intensive mixing of the streams.

What is claimed is:

1. A heat treatment system, comprising:

a heat treatment device;

a first flow channel having a downstream end connected to the heat treatment device and an upstream end operably connected to first gas source;

a second flow channel having a downstream end connected to the first flow channel and an upstream end operably connected to a second gas source;

a mixer for static mixing of a second gas stream from the second gas source into a first gas stream from the first gas source, the mixer comprising a plurality of hollow bodies longitudinally extending in a flow direction within the first flow channel, the hollow bodies being spaced apart to allow the first gas stream to flow around the hollow bodies, each of the hollow bodies having an inlet facing the downstream end of the second flow channel for receiving the second gas stream and an outlet in the first flow channel for mixing the second gas stream with the gas from the first gas stream flowing around the hollow bodies, wherein the downstream end of the second flow channel is closed over its cross section by a wall outside the inlets of said hollow bodies, thereby forcing the second gas stream source to exit the second flow channel and enter the first flow channel only through the hollow bodies.

2. A heat treatment system according to claim 1, further comprising a fan provided in the first flow channel downstream of the mixer for drawing air from the mixer and into the heat treatment device.

3. A heat treatment system according to claim 2, wherein the first gas source comprises at least gas drawn by the fan from the heat treatment device.

4. A heat treatment system according to claim 3, wherein the heat treatment device is a dryer and the first gas stream further comprises a source of dry ambient air.

5. A heat treatment system according to claim 4, wherein the second gas stream comprises gas having at least one of higher temperature and pressure than the first gas stream source.

6. A heat treatment system according to claim 5, wherein the second gas source is an exhaust from another energy assembly.

7. A heat treatment according to claim 6, wherein the dryer is a screen drum dryer for drying a web of goods wrapped around a drum therein.

8. A heat treatment system according to claim 1, wherein downstream ends of the hollow bodies narrow to form a nozzle end, and wherein the outlet comprises at least an opening in the nozzle end.

9. A heat treatment system according to claim 8, wherein the outlet of each hollow body comprises the opening in the nozzle end and a side opening provided in the hollow body at a location where the narrowing begins.

* * * * *